US012678672B2

(12) United States Patent
Kamoda

(10) Patent No.: US 12,678,672 B2
(45) Date of Patent: Jul. 14, 2026

(54) GRIP FOR GOLF CLUB

(71) Applicant: Masashi Kamoda, Irvine, CA (US)

(72) Inventor: Masashi Kamoda, Irvine, CA (US)

( * ) Notice: Subject to any disclaimer, the term of this patent is extended or adjusted under 35 U.S.C. 154(b) by 887 days.

(21) Appl. No.: 17/894,979

(22) Filed: Aug. 24, 2022

(65) Prior Publication Data

US 2023/0047333 A1 Feb. 16, 2023

(51) Int. Cl.
*A63B 53/14* (2015.01)
*A63B 60/14* (2015.01)

(52) U.S. Cl.
CPC ..... *A63B 53/14* (2013.01)

(58) Field of Classification Search
CPC ..... A63B 60/08; A63B 60/14; A63B 60/16; A63B 60/06; A63B 53/14; A63B 53/15; A63B 53/00
USPC ..... 470/300, 303, 314; 473/201
See application file for complete search history.

(56) References Cited

U.S. PATENT DOCUMENTS 6,800,234 B2 * 10/2004 Ferguson et al. ..... B29C 33/38 264/220
9,907,993 B2 * 3/2018 Penny ..... A63B 23/16 482/108
2003/0157991 A1 * 8/2003 Huang ..... A63B 53/14 473/300
2007/0082750 A1 * 4/2007 Rose ..... A63B 53/14 473/300

FOREIGN PATENT DOCUMENTS

JP 2000000334 A * 1/2000 ..... A63B 60/54
JP 2000024155 A * 1/2000 ..... A63B 53/14
JP 2020-018386 A 2/2020

* cited by examiner

*Primary Examiner* — David L Lewis
(74) *Attorney, Agent, or Firm* — IP Business Solutions, LLC.

(57) ABSTRACT

A grip for a golf club has a higher gripping force than in the past, and with a good gripping feel. A grip has a cylindrical part and a plurality of projections are formed on the surface. First projections are formed in a scale shape, and when a golfer swings the golf club, these are formed to dig into the golfer's hand and gloves. Of the oblique sides in the circumferential direction of the first projections, the sides nearer the reference point are the first oblique sides, and the sides farther from the reference point are the second oblique sides. The first oblique sides are formed to have a greater slope than the second oblique sides. The grip obtains a higher grip force by the angle of the oblique sides and the scale-shaped shape. As a result, the trajectory of the ball struck by the golf club is stable, and it is possible to extend the flying distance of the ball.

5 Claims, 5 Drawing Sheets

GRIP FOR GOLF CLUB

TECHNICAL FIELD

The present invention relates to a golf club grip.

BACKGROUND ART

A golf club grip is provided on the base end side of the shaft of a golf club, and is the part gripped by the hands of golfer. There is a demand for this grip to have a function of efficiently transferring the force inputted from the golfer's hands to the shaft and head during the swing.

Known as a conventional grip is an item in Patent Document 1 in which a plurality of intersecting grooves are provided on the surface of a cylindrical part, and on which square or diamond-shaped projections (islands) are formed. In Patent Document 1, disclosed are items in which the groove shape is a V shape and a rectangular shape in the section view. Also, disclosed are items in which the shape of the projections is a square and a diamond shape in the front view. In the grip noted in Patent Document 1, anti-slip performance is improved by the groove shape and the projection shape.

PRIOR ART DOCUMENTS

Patent Documents

[Patent Document 1] Unexamined Patent Publication No. 2020-018386

SUMMARY OF THE INVENTION

Problems the Invention is Intended to Solve

In this way, though attempts have been made to improve grip force (anti-slip performance) in grips in the past, there is a demand in the market for grips that have a higher grip force and feel good when gripped.

The purpose of the present invention is to provide a grip for a golf club, the grip having higher grip force than conventionally. Another purpose of the present invention is to provide a grip with a good gripping feel.

Means for Solving the Problems

To achieve the purposes noted above, a golf club grip of the present invention is a grip having a cylindrical part mounted on the shaft of a golf club, characterized in that in the section view in the surface orthogonal to the axial direction of the cylindrical part, a plurality of projections are arranged symmetrically in the circumferential direction from a prescribed reference point, the projections have two oblique sides in the circumferential direction in the section view, the side closer to the reference point being a first oblique side, and the side farther from the reference point being a second oblique side, and compared to the second oblique side, the first oblique side has a steeper slope with respect to the outer circumference surface of the cylindrical part.

According to the golf club grip of the present invention, compared to the second oblique side, the first oblique side of the projections has a steeper slope with respect to the outer circumference surface of the cylindrical part, and the projections are arranged symmetrically in the circumferential direction with respect to a reference point. When a golfer grips the grip and swings the golf club, twisting occurs respectively in the clockwise direction or the counterclockwise direction centered around the central axis of the shaft. In the grip of the present invention, whether twisting occurs in either direction, a high grip force is obtained because the first oblique side of the projections digs into the hand (including gloves) of the golfer.

In the golf club grip of the present invention, the projections may be formed in a diamond shape in the front view, and the diagonal lines of the diamond shape may be oriented in the axial direction and the circumferential direction of the cylindrical part. By having the shape of the projections be a diamond shape (scale shape) in the front view, when the golfer grips the grip and swings, a high grip force is obtained by the peak parts of the diamond shapes digging into the golfer's hands.

Also, in the golf club grip of the present invention, of the outline sides of the projections that form the diamond shape, when the pair of sides closer to the reference point are set as the first outline sides, and the pair of sides farther from the reference part are set as the second outline sides, the second outline sides may be formed to be shorter than the first outline sides. According to this configuration, when the golfer grips the grip and swings, it is easier for the peak part of the first outline sides to dig into the hands of the golfer.

Also, in the golf club grip of the present invention, grooves are formed between the plurality of projections, and the grooves may have a bottom part formed that is parallel to the outer circumference surface of the cylindrical part. According to this configuration, in a state in which a desired length is kept for the gap between projections, it is possible to set the angle between the first oblique side and the second oblique side to a desired angle. Also, by providing the bottom part, even in a state when the golfer is wearing gloves, the projections can easily dig into the gloves.

Also, in the golf club grip of the present invention, the cylindrical part is formed with a first area for the golfer's front side hand to grip, and a second area for the forward side hand to grip, and the projections may be formed on the first area while the second projections are formed in the second area with lower height than the projections.

According to this configuration, the projections are provided in the first area where high grip force is needed, and the second projections are provided in the second area where not much grip force is needed, so the grip overall has a good balance of grip force. Also, since the second projections are lower in height than the first projections, it is possible for the golfer to have a softer sense when gripping the second area.

Effect of the Invention

According to the present invention, in the grip for a golf club, by using a special shape for the shape of the projections, it is possible to obtain a higher grip force than in the past. Also, using the second projections, it is possible to give the golfer a good feel when gripping the grip.

MODES FOR CARRYING OUT THE INVENTION

Figure 1A:
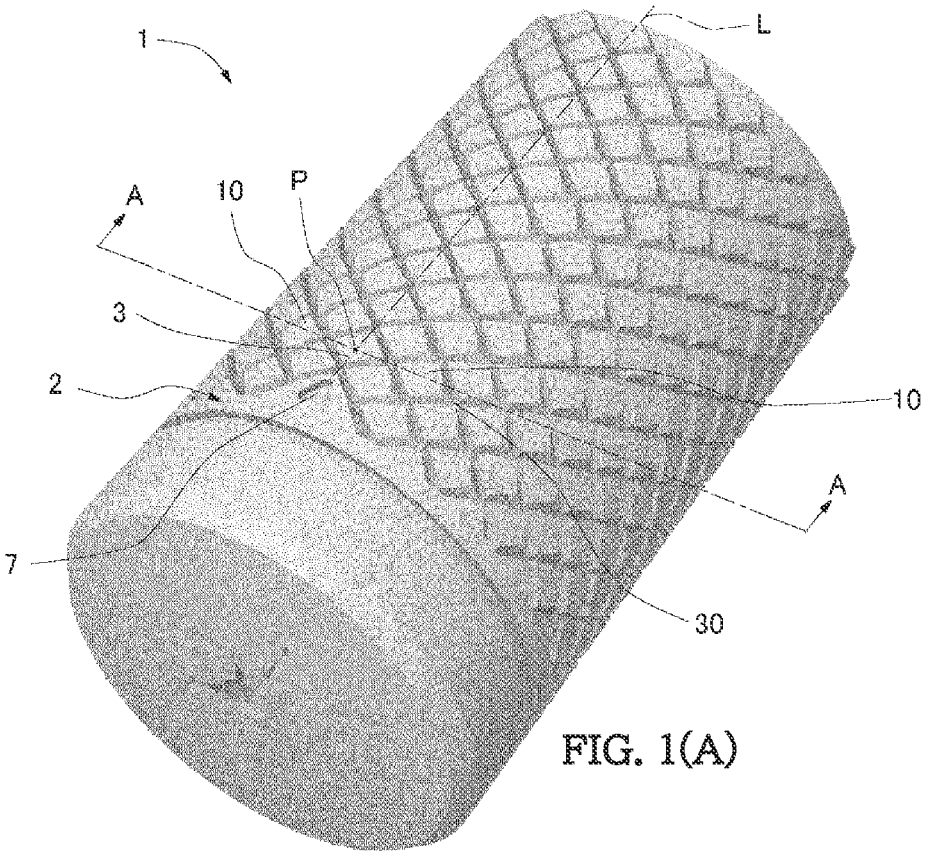
FIG. 1(A) is an explanatory drawing showing the surface of the base end side of a grip of the present embodiment.
Figure 1B:
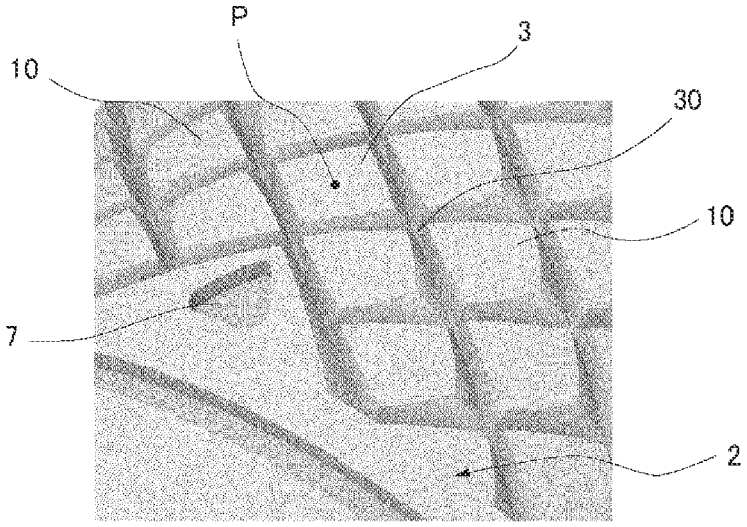
FIG. 1(B) is a partial enlarged view of FIG. 1(A).

Next, a grip for a golf club which is an example of an embodiment of the present invention is explained while referring to FIG. 1 to FIG. 5. FIG. 1 (A) is a perspective view showing the shape of the base end side of a grip 1 of the present embodiment. The grip 1 has a cylindrical part 2 mounted on the shaft (not illustrated) of the golf club, and a plurality of projections are formed on the surface of the cylindrical part 2. For the material of the grip 1 of the present embodiment, a rubber composition or a resin composition used in conventional golf club grips can be used.

Figure 3:
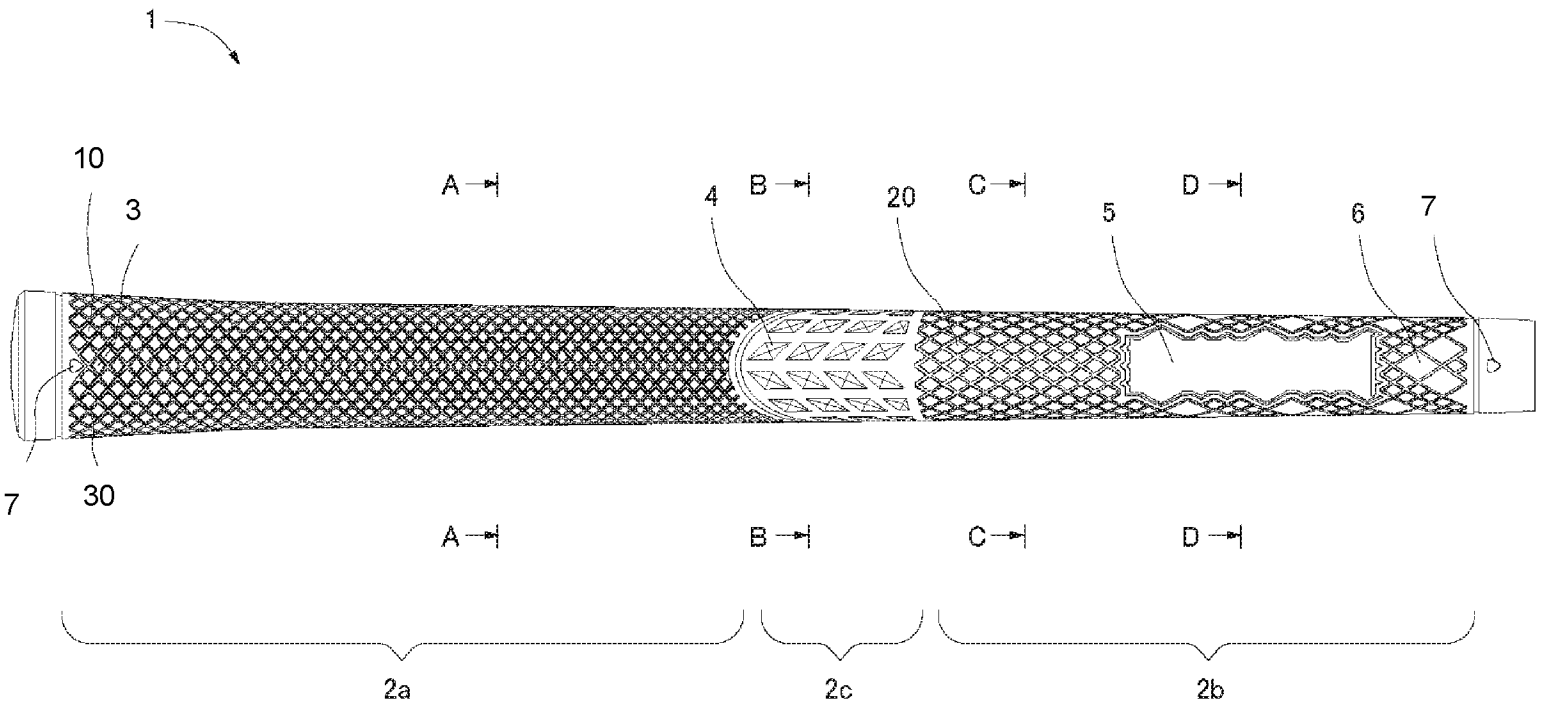
FIG. 3 is an explanatory drawing showing the state of the grip of the present embodiment seen from the front.
Figure 4A:
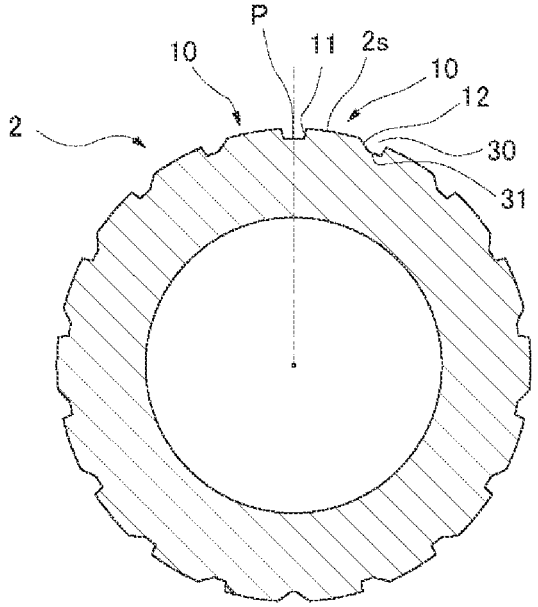
FIG. 4(A) to FIG. 4(D) are cross section views of line A-A to line D-D of FIG. 3.
Figure 4B:
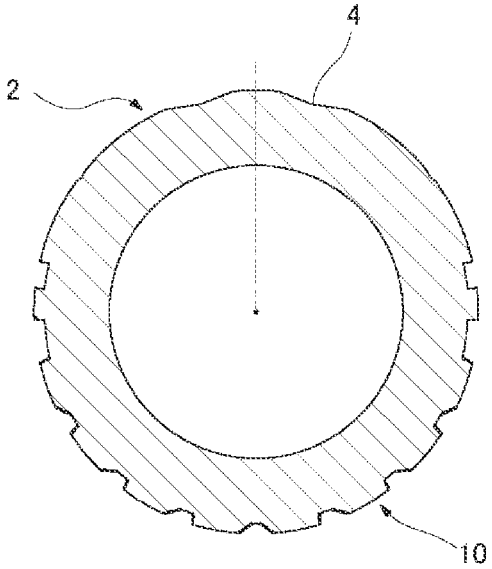
Figure 4C:
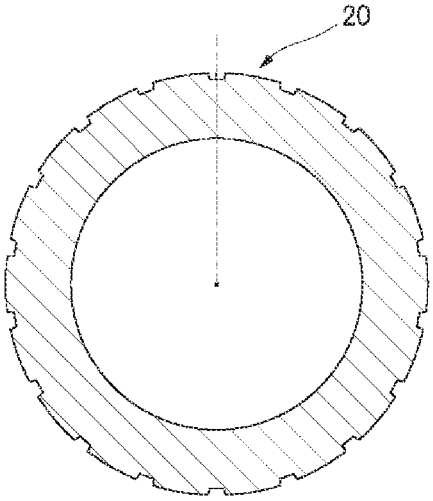
Figure 4D:
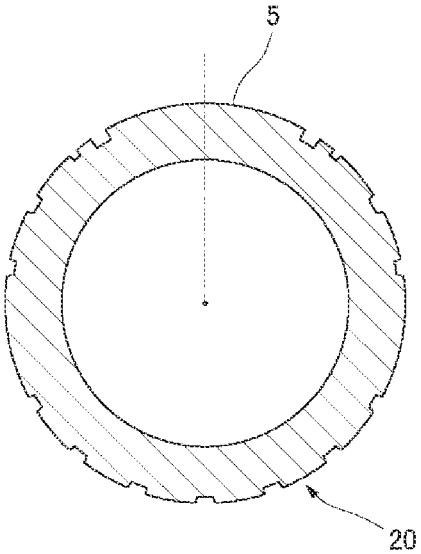

In the present embodiment, as the projections, as shown in FIG. 1 (A), comprised are first projections 10 (projections in the application of the present application), a plurality of which are formed on the surface of the cylindrical part 2. Also as projections, in the cylindrical part 2, comprised are a plurality of center projections 3 on a virtual reference line L extending in the axial direction. Also, as shown in FIG. 3, second projections 20 are provided on the tip side of the grip 1. In the present embodiment, the first projections 10 are projections that are mainly responsible for improving the grip force in the grip 1.

Figure 2A:
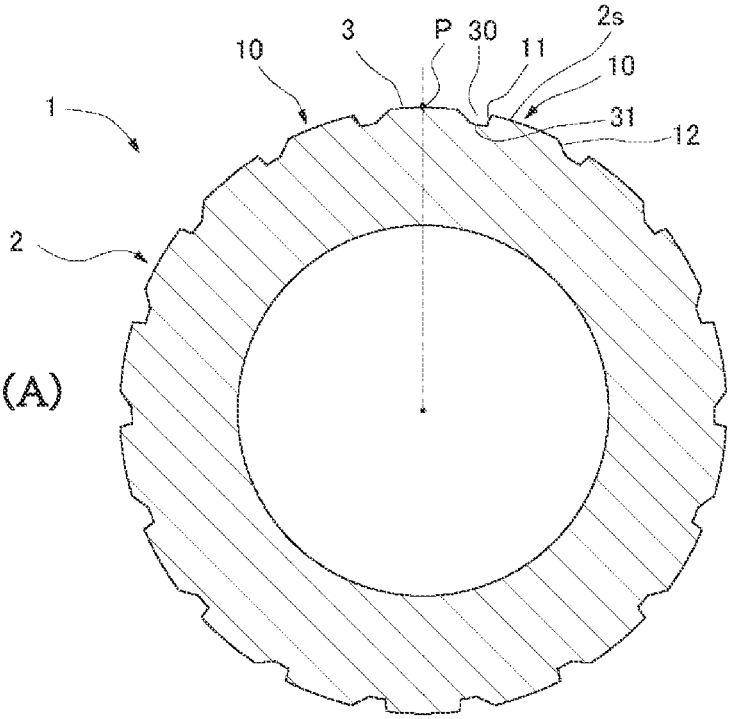
FIG. 2(A) is cross section of line A-A in FIG. 1(A)
Figure 2B:
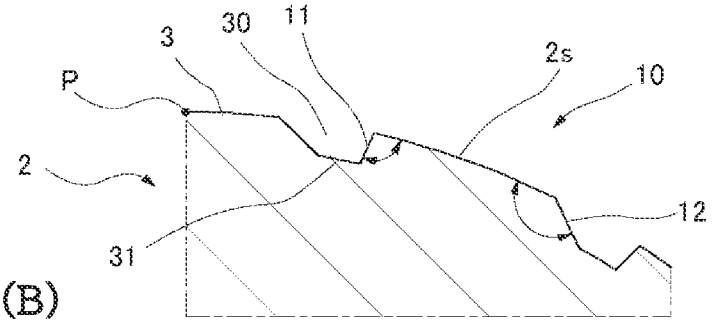
FIG. 2(B) is a partial enlarged view of FIG. 2(A)
Figure 2C:
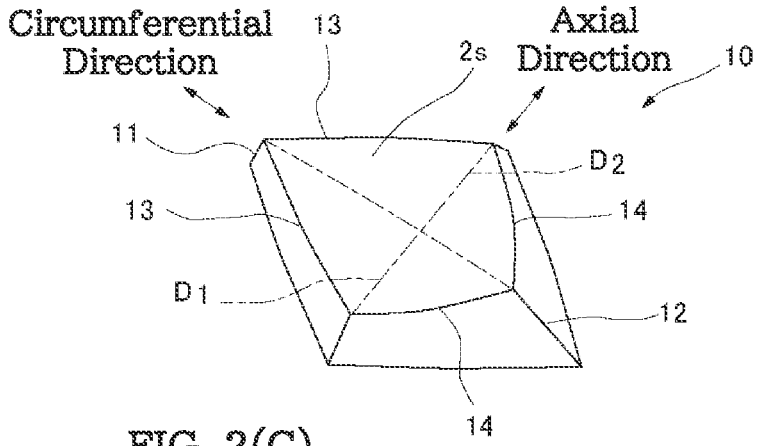
FIG. 2(C) is an explanatory drawing showing the shape of first projections.

As shown in FIG. 1 to FIG. 3, the first projections 10 are formed in diamond shapes in a front view of the cylindrical part 2, and have a so-called scale shape. As shown in FIGS. 2 (A) and (B), the first projections 10 have two oblique sides in the circumferential direction in the section view in the surface orthogonal to the axial direction of the cylindrical part 2. In specific terms, the first projections 10 comprise a first oblique side 11 having a steep slope with respect to an outer circumference surface 2*s* of the cylindrical part 2, and a second oblique side 12 having a gentle slope with respect to the outer circumference surface 2*s* of the cylindrical part 2.

The first oblique side 11 is provided at a position closer to a virtual reference point P of the cylindrical part 2 than the second oblique side 12. This reference point P is a point provided at a prescribed position of the cylindrical part 2, and may be a virtual point, or may be formed by an actual projection or recess.

As shown in FIG. 2 (A), the plurality of same shape first projections 10 are arranged on the cylindrical part 2 with lateral symmetry in the circumferential direction from the reference point P. In specific terms, the center projections 3 are provided in the center including the reference point P, the first projections 10 are provided at left and right sandwiching grooves 30, and a plurality of the first projections 10 are further provided sandwiching the grooves 30. As shown in FIGS. 2 (A) and (B), in the grooves 30 of the present embodiment, a bottom part 31 is formed on the surface parallel to the outer circumference surface of the cylindrical part 2.

As shown in FIG. 2 (C), the first projection 10 is formed in a diamond shape in the front view of the cylindrical part 2. Of the four outline sides that form this diamond shape, the pair of sides closer to the reference point P are first outline sides 13, and the sides that are farther are second outline sides 14. In the present embodiment, the second outline sides 14 are formed to be shorter than the first outline sides 13. Also, in the present embodiment, the first outline sides 13 and the second outline sides 14 are gently curved outward in an arc shape.

Also, in the present embodiment, in the first projections 10, of the pair of diagonal lines connecting the peaks of the diamond shape, one diagonal line D1 is faced in the axial direction of the cylindrical part 2, and the other diagonal line D2 is faced in the circumferential direction of the cylindrical part 2. These diagonal lines may be oriented strictly to match the axial direction and the circumferential direction, but may also be angled with respect to these directions.

Next, the overall configuration of the grip 1 of the present embodiment is explained while referring to FIG. 3 and FIG. 4. FIG. 3 is a drawing showing the state of the grip 1 of the present embodiment seen from the front, with the left side of the drawing being a first area 2*a*, and the right side of the drawing being a second area 2*b*. Also, a middle area 2C is provided between the first area 2*a* and the second area 2*b*.

When the golfer is right-handed, the front side hand of the golfer that grips the grip 1 is the left hand, and the first area 2*a* is gripped by the left hand. At this time, the thumb of the left hand is placed in the middle area 2C. Also, the forward side hand of the golfer is the right hand, and the second area 2*b* is gripped by the right hand.

The first projections 10 are provided in the first area 2*a*, and diamond shaped recesses 4 are formed on the surface of the middle area 2C. The second projections 20 are provided in an area at the base end side of the second area 2*b*, and in addition to the second projections 20, a display unit 5 that can display a trademark, etc., of the grip 1, and a decorative projection 6 for decoration are provided in the forward side area. Also, in the present embodiment, a reference mark 7 that indicates the position of the reference point P is provided near the edge of the base end side and near the edge of the forward side of the grip 1.

In FIG. 3, the cross section of the A-A part is a cross section of a location where there are no center projections 3 at the reference point P, and the cross section shape is shown in FIG. 4 (A). As shown in FIG. 4 (A), the first projections 10 are arranged laterally symmetrically along the entire area of the cylindrical part 2 with the reference point P in the center.

The B-B part in FIG. 3 is a cross section of the middle area 2C in which the recesses 4 are formed, and the cross section shape is shown in FIG. 4 (B). The recess 4 has a shape recessed by pressing a quadrangular pyramid from the outer circumference surface 2*s* of the cylindrical part 2. Also, as shown in FIG. 4 (B), in the middle area 2C, recesses 4 are provided on the front surface, and the first projections 10 are provided on the back surface.

The C-C part in FIG. 3 is the cross section of the second area 2*b* in which the second projections 20 are provided, and the cross section shape is shown in FIG. 4 (C). As shown in FIG. 4 (C), the second projections 20 are provided along the entire area of the cylindrical part 2 in the second area 2*b*.

The D-D part in FIG. 3 is the cross section of the part in which the display unit 5 is provided in the second area 2*b*, and the cross section shape is shown in FIG. 4 (D). As shown in FIG. 4 (D), the second projections 20 are provided on the back surface side of the location in which the display unit 5 of the cylindrical part 2 is provided.

Figure 5A:
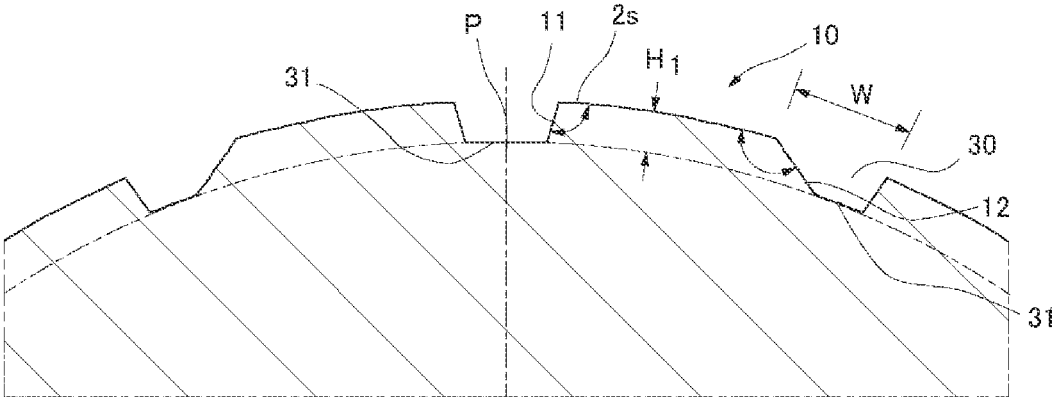
FIG. 5(A) is an enlarged cross section view of the first projections.
Figure 5B:
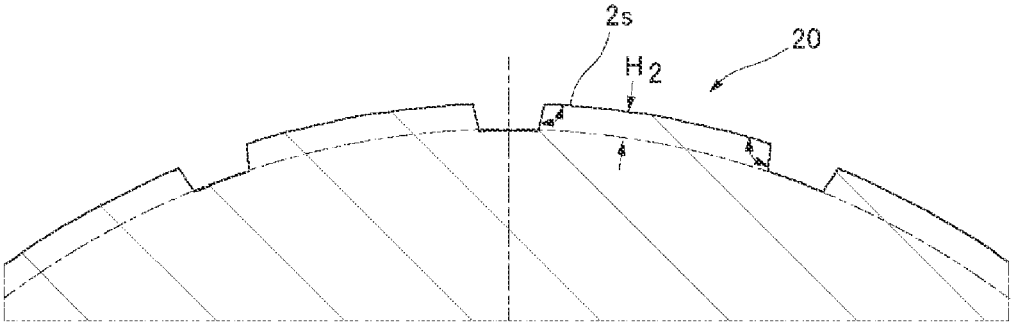
FIG. 5(B) is an enlarged cross section view of second projections.

FIG. 5 (A) is an enlarged cross section view of the first projection 10, and FIG. 5 (B) is an enlarged cross section view of the second projection 20. As shown in FIG. 5 (A), the height $H_1$ of the first projections 10 is the height between the outer circumference surface 2*s* of the cylindrical part 2 and the surface by which the bottom part 31 of the groove 30 extends in the circumferential direction, and in the present embodiment is 0.43 mm. Also, in the present embodiment, a width W of the grooves 30 between first projections 10 is formed to be 1.3 mm (bottom width is 0.38 mm). In the present embodiment, the angle of the first oblique side 11 is 103°, and the angle of the second oblique side 12 is 141°.

Meanwhile, the height $H_2$ of the second projections 20 is 0.31 mm. In this way, in the present embodiment, the height of the second projections 20 is formed to be lower than the height of the first projections 10. Also, the angle of the second projections 20 is 103°.

In the grip 1 of the present embodiment, the first projections 10 and the grooves 30 of the first area 2*a* have the configuration noted above, so it is possible to obtain a reasonable grip pressure. Also, the second area 2*b* part is often gripped by the golfer's bare hands, but the second projections 20 are formed to be lower than the first projections 10, so it is possible to give a soft grip feeling.

According to the grip 1 of the present embodiment, when the golfer grips the golf club and swings, even if there is a mishit of the ball, because the first projections 10 of the grip 1 dig into the hands of the golfer, slipping between the golf club and the golfer's hands is prevented, and this prevents mistakes from worsening. Therefore, according to the grip 1 of the present embodiment, improvement in the directionality of the struck ball and extending of the flying distance can be expected.

Also, in the grip 1, the reference mark 7 indicating the position of the reference point P is provided, and furthermore, the center projections 3 along the virtual reference line L are provided along the axial direction of the cylindrical part 2. For this reason, the golfer can easily ascertain the correct direction of the golf club when viewing the grip 1, and the position for gripping the grip 1 is made clear.

The height $H_1$ of the first projections 10, the height $H_2$ of the second projections 10, the angle of the first oblique side 11, the angle of the second oblique side 12, or the width W of the groove 30 in the above embodiment may be changed as appropriate depending on the material of the cylindrical part 2, and the type of golf club.

EXPLANATION OF CODES

1 Grip
2 Cylindrical part
2*s* Outer circumference surface
3 Center projection
10 First projection
11 First oblique side
12 Second oblique side
20 Second projection
30 Groove
31 Bottom part
P Reference point

The invention claimed is:

1. A golf club grip, comprising:

a cylindrical part mounted on a shaft of a golf club, the cylindrical part having inner and outer circumference surfaces, the inner circumference surface being in contact with the shaft when the cylindrical part is mounted on the shaft, the outer circumference surface being opposite to the inner side, wherein, in a section view in a surface orthogonal to an axial direction of the cylindrical part, a plurality of projections are arranged on the outer circumference surface symmetrically in a circumferential direction from a prescribed reference point, the projections have two oblique sides in a circumferential direction in the section view, a side closer to the reference point being a first oblique side, and a side farther from the reference point being a second oblique side, and compared to the second oblique side, the first oblique side has a steeper slope with respect to the outer circumference surface of the cylindrical part.

2. The golf club grip according to claim 1, wherein the projections are formed in a diamond shape in a front view, and diagonal lines of the diamond shape are faced in an axial direction and a circumferential direction of the cylindrical part.

3. The golf club grip according to claim 2, wherein, of outline sides of the projections forming the diamond shape, when a pair of sides near the reference point are first outline sides, and a pair of sides far from the reference point are second outline sides, and the second outline sides are formed to be shorter than the first outline sides.

4. The golf club grip according to claim 1, wherein grooves are formed between the plurality of projections, and the grooves have a bottom part formed in parallel with the outer circumference surface of the cylindrical part.

5. The golf club grip according to claim 1, wherein the cylindrical part has formed a first area for the golfer's front side hand to grip, and a second area for the forward side hand to grip, and the projections are formed on the first area, and second projections are formed in the second area with lower height than the projections.

* * * * *